United States Patent [19]

Koyama

[11] 4,162,037

[45] Jul. 24, 1979

[54] AUTOMATIC SPRAYER

[76] Inventor: Masaya Koyama, 4-21-4, Kizuri, Higashiosaka-shi, Osaka-fu, Japan

[21] Appl. No.: 816,354

[22] Filed: Jul. 18, 1977

[30] Foreign Application Priority Data

May 20, 1977 [JP] Japan ..... 52-59058

[51] Int. Cl.[2] ..... B05B 9/04

[52] U.S. Cl. ..... 239/332; 222/333; 222/401

[58] Field of Search ..... 239/332; 222/333, 401, 222/402

[56] References Cited

U.S. PATENT DOCUMENTS

| | | | |
|---|---|---|---|
| 2,410,692 | 11/1946 | Strobell | 239/332 |
| 3,352,497 | 11/1967 | Abramson | 239/332 |
| 3,462,082 | 8/1969 | Everett | 239/332 |
| 3,901,449 | 8/1975 | Bochmann | 239/332 |

*Primary Examiner*—Robert B. Reeves
*Assistant Examiner*—Andres Kashnikow
*Attorney, Agent, or Firm*—Wm. Jacquet Gribble

[57] ABSTRACT

An automatic sprayer comprising a spray body, a prime mover mounted to the spray body, a geared eccentric drive operatively associated with the prime mover, a nozzle body to be driven into oscillating motion by means of the a geared eccentric drive, whereby treatment liquid contained in a container is sprayed by oscillating motion of the nozzle body. Spraying may be carried out upon oscillating motion of the nozzle body, thus resulting in efficient dispersion of liquid.

2 Claims, 5 Drawing Figures

Fig. 1
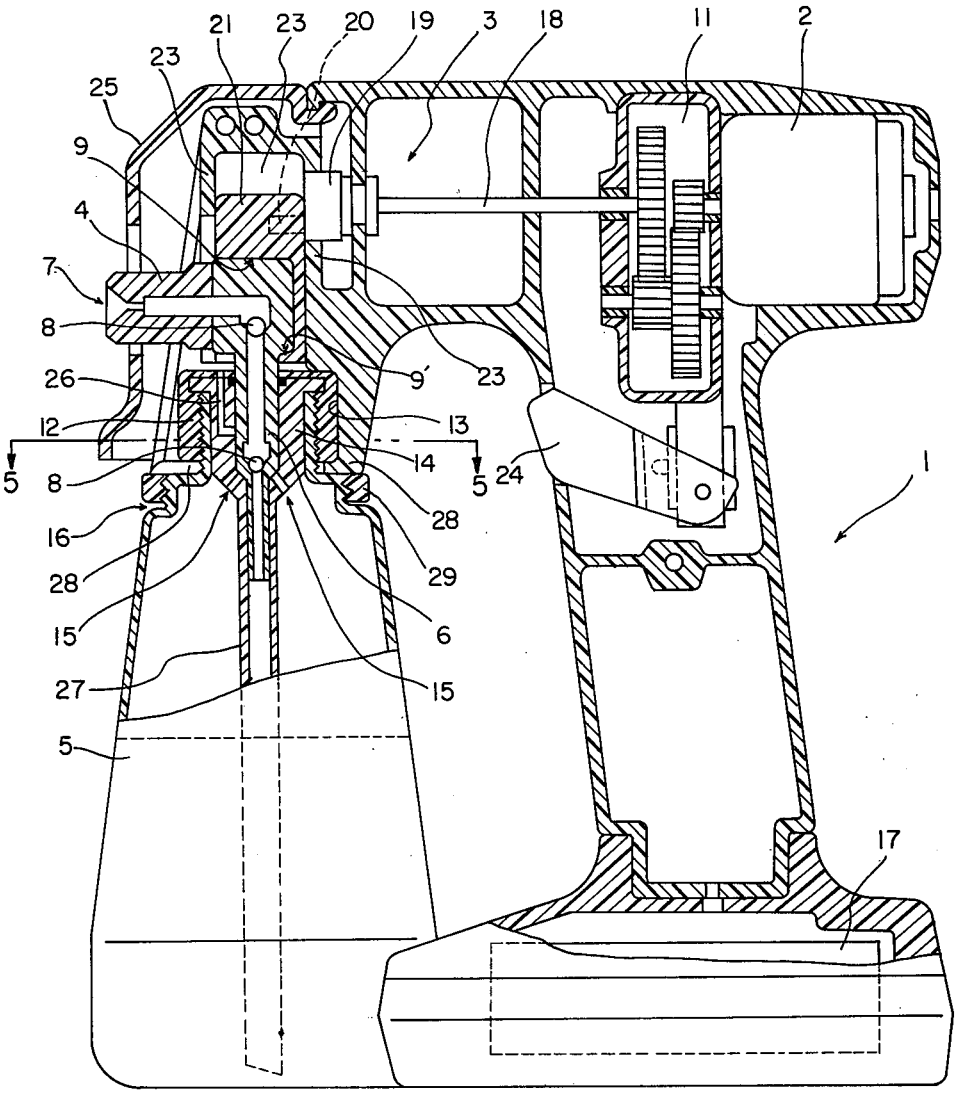
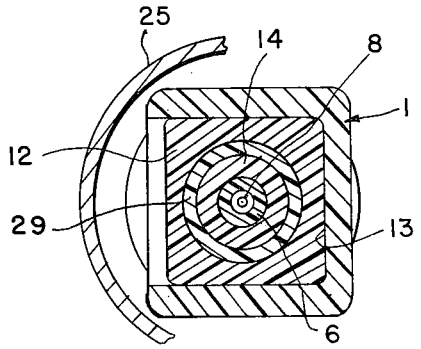
FIG. 5

AUTOMATIC SPRAYER

BACKGROUND OF THE INVENTION

The present invention relates to automatic sprayers for spraying cosmetic, medical or coating liquid.

Conventionally, there have been known, for example, manually operated sprayers to be used in ironing, or automatic ones fitted with a prime mover to be used for spraying upon plants. In addition to the above, for the cosmetic treatment or coating purpose there have been also used sprayers of the type which are operated by pressure of liquefied gas sealingly contained together with spray liquid in a container. However, in many countries, restrictions are being imposed on the use of such sprayers in view of various troubles caused by gases used therein, and accordingly, the use of such typed sprayers may not be permitted in the future.

The above-mentioned conventional manually-operated sprayers are constructed in such a way that a nozzle body is lowered by pressing action of the thumb, so as to cause the liquid to be sprayed, and after the nozzle body has been returned to the original position from the lowermost depressed position by force of a spring, such pressing may be repeated.

Such sprayers have certainly advantages, for example, spraying may be carried out by moving the nozzle body upward and downward, thereby to permit liquid to be dispersed in a certain vertical range. However, operators will get very tired if trying to keep spraying continued, in that sprayers are manually operated and spring return action is utilized.

On the contrary, automatic sprayers may enable continuous spraying at ease. However, such automatic sprayers have also defects; that is, in conventional automatic sprayers, a nozzle body is normally fixed to a spray body in a unitary construction, and spraying is not carried out in the pressing system of the manually operated type in which air is compressed by using a plunger, thereby to requiring an operator to direct the nozzle toward an object. Furthermore, such conventional automatic sprayers may produce spray of relatively larger particles than those obtained by manually operated sprayers of the type in which air is compressed by using a plunger.

Accordingly, in spraying, for example, medical liquid with such sprayers, sterilizing effect may be reduced, thereby to necessitate manual scattering. On the other hand, in spraying coating material with such sprayers, efficient, thinnest and uniform coating may not be expected.

SUMMARY OF THE INVENTION

In view of such inconveniencies, it is an object of the present invention to provide automatic sprayers which may automatically produce spray of fine particles in the widely scattered form in a certain vertical range.

In order to achieve such object, the present invention comprises a spray body, a prime mover mounted to the spray body, driving means operatively associated with the prime mover, a nozzle body adapted to be oscillated by driving means, and a container containing liquid which is adapted to be sprayed, upon oscillating motion of the nozzle body.

It should be noted that the above-mentioned object can be achieved by employing a never thinkable system in which the nozzle body is directly driven into oscillating motion by electric power.

It is another object of the present invention to provide sprayers in which the nozzle body is constructed independently from the spray body, thus permitting replacement of the nozzle body alone if the nozzle body gets clogged somewhere therein. In the prior art, the nozzle body is integral with the spray body, and when the nozzle body gets clogged somewhere therein, the operator may often disuse the entire spray body without clearly knowing what is wrong.

It is further object of the present invention to provide automatic sprayers in which not only the nozzle body, but also the liquid-containing container is constructed independently from the spray body, thus permitting the efficient use of only one spray body for various kinds of containers and nozzle bodies, each thereof being suitable to each of containers, dependent on the purposes such as cosmetic, medical or coating spraying.

BRIEF DESCRIPTION OF THE DRAWINGS

The above and other objects and advantages of the present invention will be further clarified in the following description, referring to the accompanied drawings, showing by way of example one embodiment of an automatic sprayer in accordance with the present invention, in which;

FIG. 1 is a longitudinal cross sectional side view of the assembly in accordance with the present invention;

FIG. 5 is a sectional view taken along line 5—5 of FIG. 1.

DESCRIPTION OF THE PREFERRED EMBODIMENT

Figure 2:
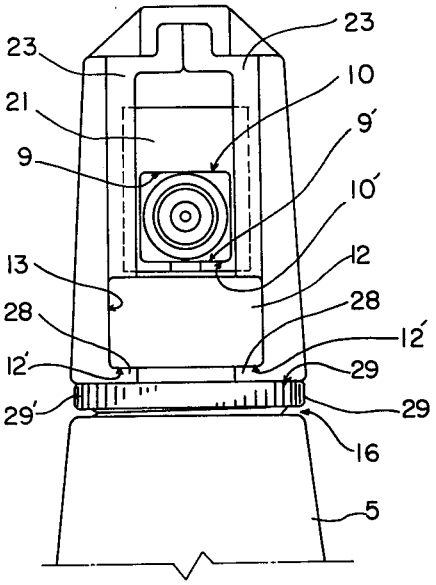
FIG. 2 is a front view of the main portions with a front cover removed.
Figure 3:
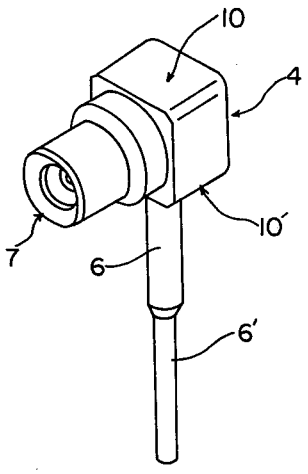
FIG. 3 is a perspective view showing a nozzle body.
Figure 4:
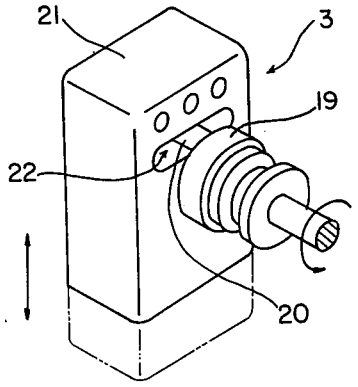
FIG. 4 is a perspective view of driving means.

Referring now to the drawings illustrating by way of example a cosmetic sprayer as a preferred embodiment of an automatic sprayer in accordance with the present invention, description will be made in detail in the following.

A spray body 1 may be formed, for example, by synthetic resin. A prime mover 2 is mounted to the spray body 1, and in this example it is an electric motor to be operated by storage batteries 17 housed in the lower portion of the spray body 1. A switch 24 is provided for the storage batteries 17 and subsequently the prime mover 2. Reduction means 11 is provided at the inside thereof with reduction gears for reducing rotational frequency transmitted from the prime mover 2 and then transmitting thus reduced rotational frequency as output. A driving shaft 18 is coupled at one end thereof to the reduction means 11 and at the other end thereof to driving means 3. Driving means 3 comprises a crank 19 provided with a pin 20 and a sliding member 21 disposed slidably only in the vertical direction, and may drive a nozzle body into oscillating motion, which will be described later. The pin 20 is inserted in a cam groove 22 defined in the sliding member 21, and, upon rotation of the crank 19, the pin 20 will press the upper and lower surfaces of the cam groove 22 by cam action, thereby to drive the sliding member 21 into vertical or linear reciprocal movement.

A restraint member 23 is disposed in the spray body 1 for regulating the sliding member 21 so as to move only in the vertical direction. The sliding member 21 is further provided therein with a cavity having upper and lower working surfaces 9 and 9'. The nozzle body 4 is constructed separatedly not only from the spray body 1, but also from a container 5, which will be subsequently described. The nozzle body 4 is inserted in said cavity formed in the sliding member 21, and has abutment surfaces 10 and 10' adapted to contact with the upper and lower working surfaces 9 and 9', respectively. The nozzle body 4 is further provided with a plunger 6 at the lower portion thereof and at the opposite side of the nozzle 7. The plunger 6 is provided at the lower portion thereof with a smaller diameter pipe 6'.

Valve structures 8 are disposed within the nozzle body 4 for permitting the flow of liquid only in the direction toward the nozzle 7, and may be formed by ball valves. A portion of the tip of the spray nozzle 7 projects from a slit in a front cover 25 disposed at the front of the spray body 1.

The container 5 contains cosmetic treatment liquid and the upper end 12 thereof is formed in the regular square shape as viewed from the above. At the upper end 12, a cylinder 14 is disposed, and the plunger 6 of the nozzle body 4 is adapted to insert into the cylinder 14. A through bore 15 is formed at the lower portion of the cylinder 14, so as to communicate with the container 5, and an air hole 26 defined in the approximately middle portion of the cylinder is upwardly extended and exposed to the air. A liquid sucking pipe 27 is extended from the cylinder 14 nearly to the container bottom, and the smaller diameter pipe 6' of the plunger 6 of the nozzle body 4 is vertically movably inserted into the upper portion of this liquid sucking pipe 27.

A knob 29 is threadedly mounted to the neck portion 16 of the container 5. Between the upper surface 29' of the knob 29 and the lower surface 12' of the upper end 12, the knob 29 threadedly fastens the portion 28 located below a cavity 13 disposed in the lower portion of the spray body 1, whereby the container 5 is securely fixed to the spray body 1.

In this arrangement, the container 5 may be mounted to the spray body 1 in such a way that the plunger 6 is firstly inserted into the cylinder 14 of the upper end 12 of the container 5, then, with the knob 29 loosened downwardly, the container 5 is inserted into the cavity 13 defined in the spray body 1, from the front direction, with the front cover 25 thereof removed, so that the container 5 is placed on the portion 28, and the knob 29 is subsequently fastened, thus completing container setting. It should be noted that the plunger 6 of the nozzle body 4 is inserted into the cylinder 14 rotatably around the longitudinal axis thereof, and the upper end 12 of the container 5 is constructed in the regular square form as viewed from the above, whereby even if the nozzle body 4 is faced to any direction, the container 5 may be inserted in and set to the spray body 1 from any horizontal direction. This means that even if, prior to the setting, the nozzle body 4 has not been faced to the front with respect to the upper end 12, at the time of the insertion of container 5 into the spray body 1 the nozzle body 4 strikes the side portion of the spray body front, so that the nozzle body 4 will be automatically faced to the front of the spray body 1, whereby easy setting can be accomplished.

Thus component parts constituting the present invention have been described, and now the operation thereof will be described in the following.

When the switch 24 is turned on, the prime mover 2 operates, the reduction means 11 then reduces rotational frequency, and the driving means 3 is subsequently driven. By the rotation of crank 19, the pin 20 is driven into rotational movement in a certain vertical range. Since the pin 20 has been inserted into the cam groove 22 of the only vertically slidable member 21, the pin 20 will raise the sliding member 21 from the position as shown in FIG. 1 toward the upper surface of the groove 22. At this time, the lower abutment surface 10' of the nozzle body 4 which has been fitted in the cavity of sliding member 21, will be raised by means of the upwardly facing working surface 9' of sliding member 21, so that the nozzle body 4 will be raised together with the sliding member 21. Then, the nozzle body plunger 6 moves upwardly within the cylinder 14. It should be understood that the liquid is not sprayed during this rising process.

Then, when the pin 20 starts, in turn, rotating downwardly, the downwardly facing working surface 9 of sliding member 21 will contact-press the upper abutment surface 10 of the nozzle body 4, thereby to lower the nozzle body 4. The plunger 6 disposed at the lower portion of nozzle body 4 will then compress the air contained within the cylinder 14, and accordingly, will compressingly supply thus compressed air to the inside of the container 5 via the through bore 15, as shown in FIG. 1. By forcing down the compressed air in this way, the liquid surface will be subjected to pressure, whereby the liquid will be sprayed from the nozzle 7 through the sucking pipe 27, pipe 6' and valve structures 8.

Since the nozzle body 4 is continuously driven into vertical reciprocal movement by means of the prime mover 2, spraying may be carried out dispersedly in a certain vertical range as if spraying were continuously done.

It should be therefore understood that treatment liquid may be sprayed upon the hair from the nozzle 7 in its predetermined vertically moving range, and may also be readily and uniformly sprayed upon the hair in the form of turbulent flows caused by repeated spraying with the nozzle body 4 being repeatedly lowered.

It should be also understood that medical liquid for plants may automatically, conveniently and readily be sprayed upon both the front and back sides of leaves, because the spraying action can be done in a certain vertical range.

On the other hand, the present invention is so arranged that the nozzle body 4 is positively driven into upward and downward reciprocal movement, and subsequently a spring for raising nozzle is not used, as normally provided in manually operated sprayers. If such a spring is employed in the automatic sprayer, because the length of time during which such spring is raising up the nozzle body, is not identical to the length of time during which the nozzle body is forcibly driven to rise up, the spring may become a drag against the rising movement of nozzle body, thereby to apply load to the electric motor. This is why such spring is not used in the automatic sprayer. It should be therefore understood that the elimination of such spring may permit the nozzle body 4 to be upwardly driven smoothly and easily with little drag, thereby to save energy in the storage batteries 17 accordingly.

In large-scaled sprayers, a gasolin engine may be used as the prime mover 2, and when an electric motor is used, electric power may be obtained from a separate source of power provided by leading cords, instead of from storage batteries.

Concerning the driving means 3, in addition to a crank-cam system as shown in this embodiment, any devices may be utilized as far as they are constructed so as to drive the nozzle body 4 into oscillating motion.

The objects of the present invention may of course be achieved by driving the nozzle body 4 into swivle motion.

I claim:

1. A powered sprayer comprising a spray body (1), a prime mover (2) mounted to said spray body (1), driving means (3) operatively associated with said prime mover (2), a nozzle body (4) to be driven into vertical reciprocal motion by said driving means (3) a container (5) for containing liquid, said container (5) being so constructed that said contained liquid is adapted to be sprayed upon reciprocating motion of said nozzle body (4), said nozzle body (4) being independently constructed so as to be removable from said spray body (1); an upper working surface (9) and a lower working surface (9') on said driving means, an upper abutment surface (10) and a lower abutment surface (10') on said nozzle body (4) adapted to contact said upper and lower working surfaces (9,9') respectively for vertical reciprocal motion of said nozzle body (4); said nozzle body (4) further including a nozzle (7) and a plunger (6) in the inside of said body, a valve structure (8) for permitting the flow of liquid contained in said container (5) only toward the direction of said nozzle (7); said container (5) having an upper end (12) in the regular square form as viewed from above, and said spray body (1) having an engagement cavity (13) corresponding to said upper end (12); said upper end (12) further having a cylinder (14) into which said plunger (6) of said nozzle body (4) is adopted to be inserted, said cylinder (14) having at the lower portion thereof a through bore (15) for guiding air compressed in said cylinder (14) to the inside of said container (5)

2. An automatic sprayer as set forth in claim 1, wherein said container (5) is provided at the neck portion (16) thereof with a fixing knob (29), and a portion of said spray body (1) is adapted to be fastened between the upper surface (29') of said knob (29) and said lower surface (12') of said upper end (12) by turning said knob (29), thereby to secure said container (5) to said spray body (1).

* * * * *